US005464354A

United States Patent [19]

Akman

[11] Patent Number: 5,464,354

[45] Date of Patent: Nov. 7, 1995

[54] PARALLEL AND SERIES PLUGS AND WIRING SEGMENTS FOR BALLON DISPLAY

[76] Inventor: Alp T. Akman, 1195-A Linda Vista Dr., San Marcos, Calif. 92069

[21] Appl. No.: 189,720

[22] Filed: Feb. 1, 1994

[51] Int. Cl.[6] ..... A63H 27/10; H01R 13/41

[52] U.S. Cl. ..... 439/505; 29/857; 439/611; 439/930; 446/220

[58] Field of Search ..... 439/602, 502, 439/505, 611, 619, 658, 863, 930; 446/220, 221, 222; 29/857

[56] References Cited

U.S. PATENT DOCUMENTS

| | | | |
|---|---|---|---|
| 1,927,001 | 9/1929 | Lewis | 439/505 |
| 2,900,492 | 8/1959 | Bossi | 439/611 |
| 2,984,813 | 5/1961 | Bossi | 439/619 |
| 3,104,924 | 9/1963 | Capel | 439/619 |
| 3,233,207 | 2/1964 | Ahroni et al. | 439/611 |
| 3,286,088 | 11/1966 | Ahroni | 439/619 |
| 3,396,363 | 8/1968 | Suzuki | 439/619 |
| 3,425,027 | 1/1969 | Uberbacher et al. | 439/619 |
| 3,522,579 | 8/1970 | Matsuya | 439/619 |
| 3,548,243 | 12/1970 | Macherini | 313/318 |
| 3,844,478 | 6/1888 | Spink et al. | 439/617 |
| 5,119,281 | 6/1992 | Akman | 362/253 |
| 5,282,768 | 2/1994 | Akman | 446/220 |

*Primary Examiner*—Neil Abrams
*Attorney, Agent, or Firm*—Calif Tervo

[57] ABSTRACT

A male connector plug has an electrically insulative and resilient body having a first end and a plug end and first and second bores therebetween. Each of a pair of electrically conductive pins or tines are frictionally fitted in a respective bore and trap and contact a bare section of an electrical wire with that bore. A wiring segment includes a central parallel male connector or a series male connector and end connectors attached to each end of a wire pair. A lamp assembly is connected to the tines of the central male connector. A translucent sleeve surrounds the central male connector and lamp assembly. According to a further aspect of the invention, a balloon display includes a first inflated balloon having a tube therethrough, a second inflated balloon including-an internal lamp connected to an end connector and the wiring segment disposed through the tube of the first balloon such that the central male connector and lamp assembly are within the balloon within the tube.

15 Claims, 3 Drawing Sheets

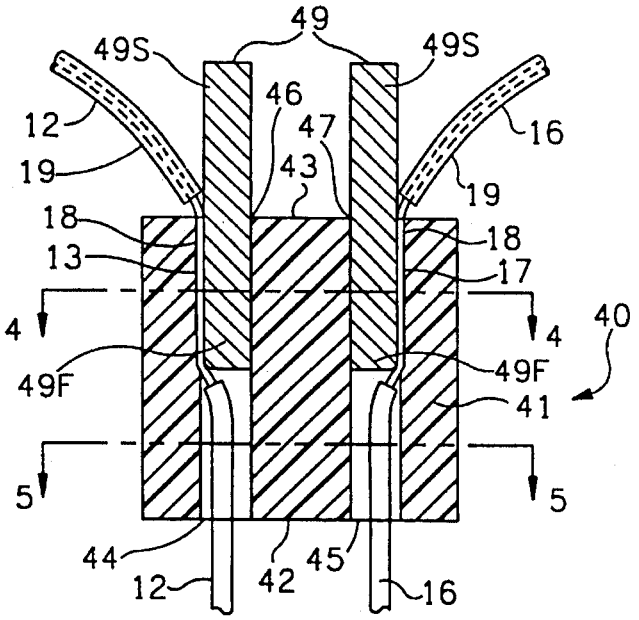
FIG. 3
FIG. 4
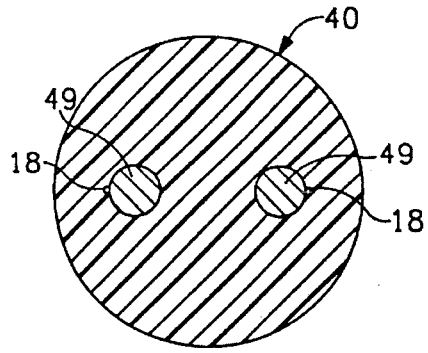
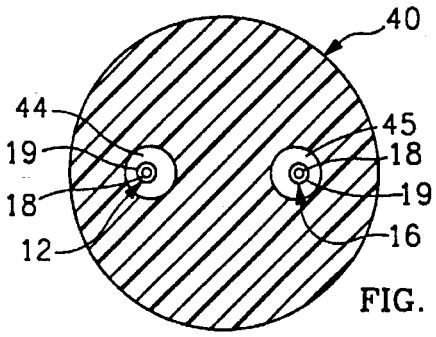
FIG. 5
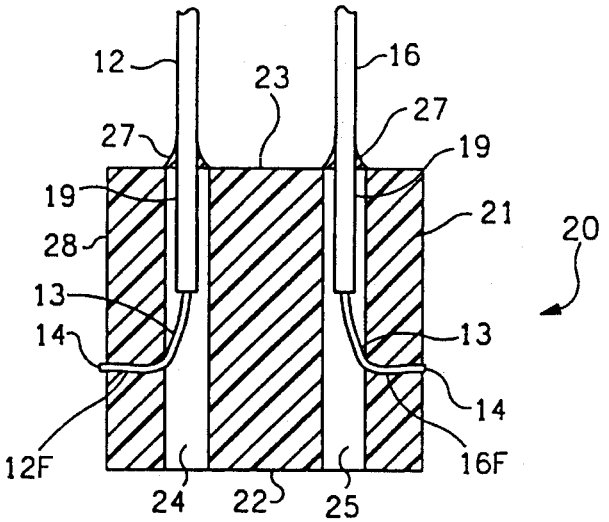
FIG. 6
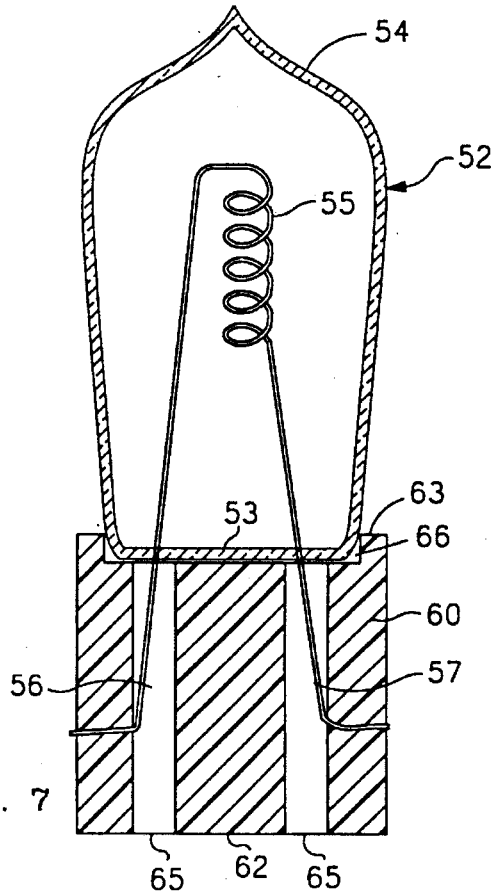
FIG. 7

PARALLEL AND SERIES PLUGS AND WIRING SEGMENTS FOR BALLON DISPLAY

BACKGROUND OF THE INVENTION

Balloons are used in displays for many reasons. For example, a balloon display may be used for advertising or simply for partying. Often it is desirable to illuminate the balloons in a display. It is particularly desirable to illuminate the balloons from the interior such that each balloon creates a colored globe effect. Often it is desirable to make displays using balloons filled with helium to create lighter than air balloons that float into a visibly favorable position.

Conventionally, the wiring and lighting devices available to achieve the above desired results, especially in combination, have notable shortcomings.

With many conventional methods, if an internally illuminated balloon in a display deflates, it is difficult to replace it. Similarly, if the light inside of a balloon burns out, it is difficult to replace.

Conventionally, the wiring and lighting components are too heavy to create many desirable displays and are particularly too heavy to function well with smaller balloons.

Therefore, it is desirable to have improved balloon display wiring and illumination such that an individual light or balloon is easily replaced.

It is further desirable that such a wiring an illumination system be extremely small and light in weight.

It is additionally desirable if such a wiring and illumination system provide for parallel wiring.

SUMMARY OF THE INVENTION

In its broadest sense, the invention comprises a male plug connector having an electrically insulative and resilient body having a first end and a plug end and first and second bores therebetween. The connector can be connected in series or in parallel to an electrical circuit.

In the parallel connector, each wire of an electrical wire pair passes through a bore. Each of a pair of electrically conductive pins or tines are frictionally fitted in a respective bore and trap and contact a bare section of an electrical wire that passes through that bore. In the series connector, a wire end is retained by each tine and a third wire for completing the series circuit, passes through a bore in the connector.

According to a further aspect of the invention, a wiring segment includes a central connector of either the parallel male connector or the series male connector and end connectors attached to each end of the wire pair. A lamp assembly is connected to the tines of the central male connector. A translucent sleeve surrounds the central male connector and lamp assembly.

According to a further aspect of the invention, a balloon display includes a first inflated balloon having a tube therethrough, a second inflated balloon including an internal lamp electrically connected to a segment end connector and the wiring segment disposed through the tube of the first balloon such that the male connector and lamp assembly are within the balloon within the tube.

Other features and many attendant advantages of the invention will become more apparent upon a reading of the following detailed description together with the drawings in which like reference numerals refer to like parts throughout.

BRIEF DESCRIPTION OF THE DRAWINGS

FIG. 3 is an enlarged cross-sectional view of a middle connector of the wiring segment of FIG. 2

FIG. 4 is a cross-section taken on line 4—4 of FIG. 3.

FIG. 5 is a cross-section taken on line 5—5 of FIG. 3.

FIG. 6 is an enlarged cross-sectional view of a female connector of the wiring segment of FIG. 2.

FIG. 7 is an enlarged vertical cross-section view of the lamp with female connector body of FIG. 2.

DETAILED DESCRIPTION OF THE INVENTION

Figure 1:
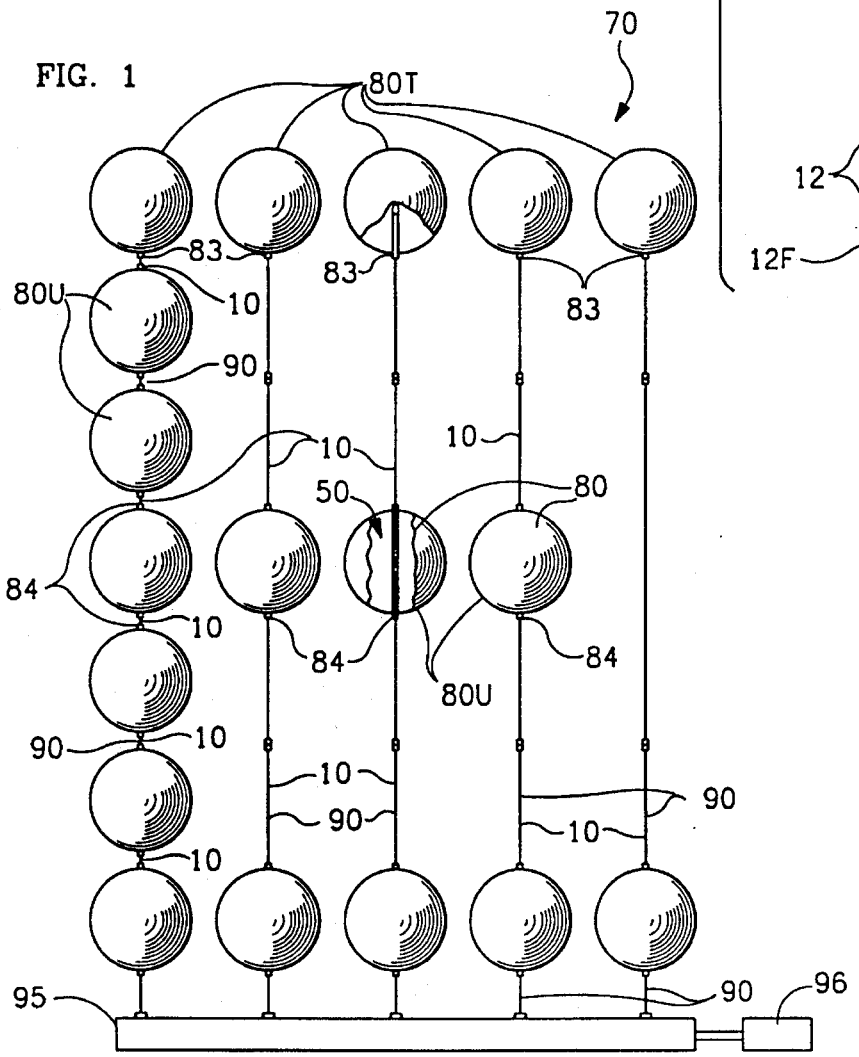
FIG. 1 is plan view of an illuminated helium balloon display spelling the letter "E".

With reference now to the drawings, there is shown in FIG. 1 a balloon display, denoted generally as 70, spelling the letter "E". Balloons displays may be arranged in a vast variety of configurations such as in arches, company logos, or flags. In display 70, shown, balloons 80 are inflated with lighter than air gas, such as helium such that they tend to float in air.

Balloons 80 are arranged in a number of columns. Preferably, balloons 80 in a given column are tethered by a single light-weight cord or wire, such as a small electrical wire, 90. Of course, many different balloon and tethering configurations are possible and the "E" of FIG. 1 is only exemplary.

Balloons 80 are illuminated. Top balloons 80T, at the top of each column, each contain an inserted light source, such as a light stick 83, such as shown and described in my prior patents, U.S. Pat. No. 4,997,403 for BALLOON LIGHTING DEVICE and U.S. Pat. No. 5,119,281 for BALLOON LIGHTING DEVICE AND METHOD.

The balloons 80 located below a top balloon 80T are called the underneath balloons 80U. Each underneath balloon 80U has a tube 84 passing therethrough, such as shown and described in my prior U.S. Pat. No. 5,282,768 titled BALLOON DISPLAY DEVICE AND METHOD. Tether wires 90 pass through balloons 80U through-tubes 84. Tether wires 90 are connected to a source of electrical energy, such as common electrical bus 95, which in turn is connected to a current source such as a plug, transformer or battery 96.

Preferably, each tether wire 90 is comprised of a series of wiring segments 10. Preferably, a wiring segment 10 is associated with each underneath balloon 80U.

Figure 2:
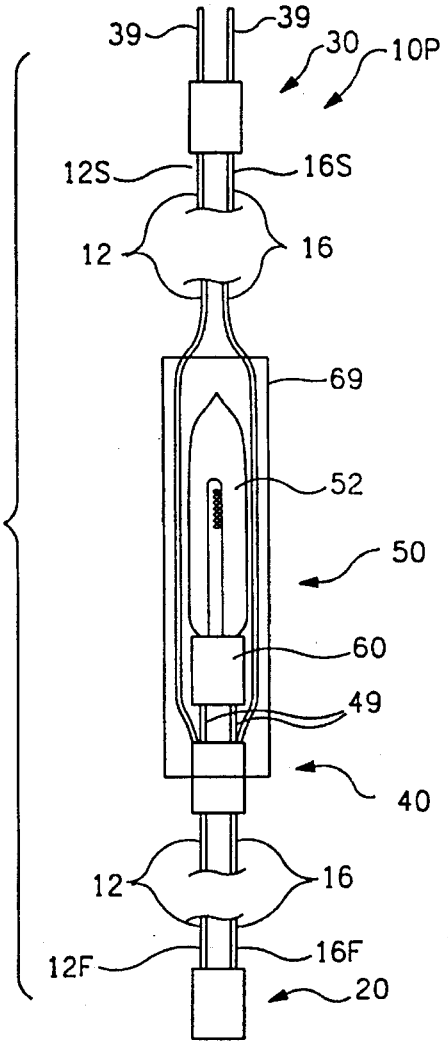
FIG. 2 is an enlarged plan view, partially cut away, of an exemplary parallel wiring segment of FIG. 1.

FIG. 2 is an enlarged view of a preferred embodiment of a parallel wiring segment, denoted generally as 10P, of FIG. 1. Parallel wiring segment 10P generally comprises a first connector, denoted generally as 20, at one end, a second connector, denoted generally as 30, at the other end, and a middle connector, denoted generally as 40, therebetween; all connected by a pair of insulated electrical wires, first wire 12 and second wire 16, both shown partially cut away. First wire 12 includes a first end 12F connected to connector 20 and a second end 12S connected to connector 30. Second wire 16 includes a first end 16F connected to connector 20 and a second end 16S connected to connector 30. Segment 10P may be of any desirable length, but is typically from slightly longer than a balloon diameter to around five feet. As illustrated in FIG. 2, Portions of wires 12,16 are removed to shorten the length of segment 10P to fit on the drawing page. Middle connector 40 includes a pair of pins or tines 49 that, in the exemplary embodiment, are attached to a lamp assembly, denoted generally as 50 such that power is supplied to lamp 52. Lamp assembly 50 includes a lamp, such as incandescent lamp 52, mounted in a female connector body 60. A translucent or transparent sleeve 69 passes over lamp assembly 50 and over wires 12, 16 where they pass by lamp assembly 50.

FIG. 3 is an enlarged cross-sectional view of middle connector 40 of wiring segment 10P of FIG. 2. Middle connector 40 may be thought of as a male plug spliced onto parallel wire pair 12,16. Middle connector 40 includes an electrically insulative and resilient body, such as cylinder 41, having a first end 42, a plug end 43 and two, parallel, longitudinal bores, first bore 44 and second bore 45, therebetween and therethrough exiting at openings 46,47 on plug end. In the exemplary embodiment, cylinder 41 is a resilient cylinder, 0.208" in diameter and 0.430" in length, preferably made of polyethylene or styrene. Insulated electrical wires 12,16 are of common low-voltage, 28–30 gauge wire having a conductive core, typically of copper 18 surrounded by electrically insulating material, insulation 19.

Upon Assembly of middle connector 40, each wire 12, 16 is passed through its respective bore 44,45. A small portion of each wire 12, 16 is stripped of insulation so as to be bare 13, 17. The non-insulated, bare portion 13, 17 of each wire is 12,16 is placed protruding from its respective bore opening 46,47 and electrically conductive pins, preferably of harder material than wire core 18, such as aluminum pins 49, are press-fit into plug end bore openings 46,47 forming a contact with bare portions 13, 17. Pins 49 include a first end 49F and a second end 49S. As the first ends 49F of pins 49 are inserted, wires 12, 16 are pushed back into bores 44, 45 and the resilient cylinder 41 firmly holds pins 49 and wires 12, 16 in place. As a result, pins 49 form a parallel male plug off the wire pair 12, 16. Because pins 49 pull wire bare portions 13, 17 into bores 44, 45 simultaneously with pin insertion, pins 49 can simply be cut from standard aluminum wire and have blunt ends and do not need to be specially formed or tapered in order to trap the wire core 18.

FIG. 4 is a cross-section taken on line 4—4 of FIG. 3.

FIG. 5 is a cross-section taken on line 5—5 of FIG. 3.

Second connector 30, shown in FIG. 2, is a male connector that can be constructed of the same materials and in the same manner as middle connector 40 except that wires 12, 16 are trimmed where they exit the bores next to the pins 39.

FIG. 6 is a vertical cross-section of first connector 20. First connector 20, shown is a female connector, but the type of first or second connectors is not germane to the invention. First connector 20 is a cylinder 21, preferably of resilient, meltable material, such as polyethylene. Cylinder 21 has a receptacle end 22, a cord end 23, and two, parallel, longitudinal bores 24, 25 therebetween. Bores 24, 25 are spaced apart and are of diameter to mate with male pins of a mating connector. A portion 13 of wires 12,16 are stripped of insulation 19 back from ends 14 . In construction of first connector 21, wires 12, 16 pass through bores 24, 25 with striped wire ends 11 just protruding from bores 24, 25 on receptacle end 22. While holding wires 12, 16 from movement from cord end 23, wire stripped end 11 is grabbed by a heated pliers and pulled into cylinder 21 toward the outside wall 28. The heated bare wire 13 melts into cylinder 21. When wire end 11 is released, the cylinder wall immediately hardens to entrap wire 12, 16. Bare section 13 is longer than the cylinder wall thickness between a bore 24, 25 and outside wall 28 such that a portion of bare section 13 remains disposed in bores 24, 25 for contact with tines of a male plug when they are inserted into bores 24, 25. Within bores 24, 25, bare wire sections 13 come out of the walls at a very shallow angle such that incoming pins face no opposition upon first encountering wire bare section 13. Preferably, ends 14 of wires 14, 16 are trimmed flush with cylinder outside wall 28. A drop of epoxy 27 attaches wires 12,16 where they exit bores 24,25.

FIG. 7 is an enlarged vertical cross-section view of lamp 52 with female connector body 60 of FIG. 2. Connector body 60 is similar to first connector 20 and includes through bores 64, 65 similar to those of FIG. 6, spaced and configured for frictional mating insertion of pins 49 of middle connector 40. Body 60 includes a receptacle end 62 and a lamp end 63. Lamp end 63 includes a recess 66 into which the base 53 of lamp 52 is seated. Lamp 52 includes glass housing 54, filament 55 and bare lead wires 56, 57. Lead wires 56,57 are attached to body 60 in the same manner as described above, i.e., by heating and pulling/melting into the wall of body 60. Once attached to body 60, lamp leads 56, 57 hold lamp 52 firmly in seat 66. Upon their insertion into bores 64, 65, middle connector pins 49 contact leads 56, 57 and make electrical contact with lamp 52.

Returning now to FIG. 2, tines 49 of middle connector 40 of wiring segment 10P are for connection to an electrically actuated device. In the exemplary embodiment shown, this actuated device is a lamp assembly 50 primarily designed for insertion in a tube, such as through-tube 84 passing through a balloon 80. Transparent or translucent sleeve 69 houses and constrains connector 40, lamp assembly 50 and wires 12, 16 such that they can easily be inserted into a through-tube 84.

Middle connector 40 can be attached by a mating female connector to any electrically actuated device, such as the light stick of my previous patent, U.S. Pat. No. 4,997,403.

Figure 8:
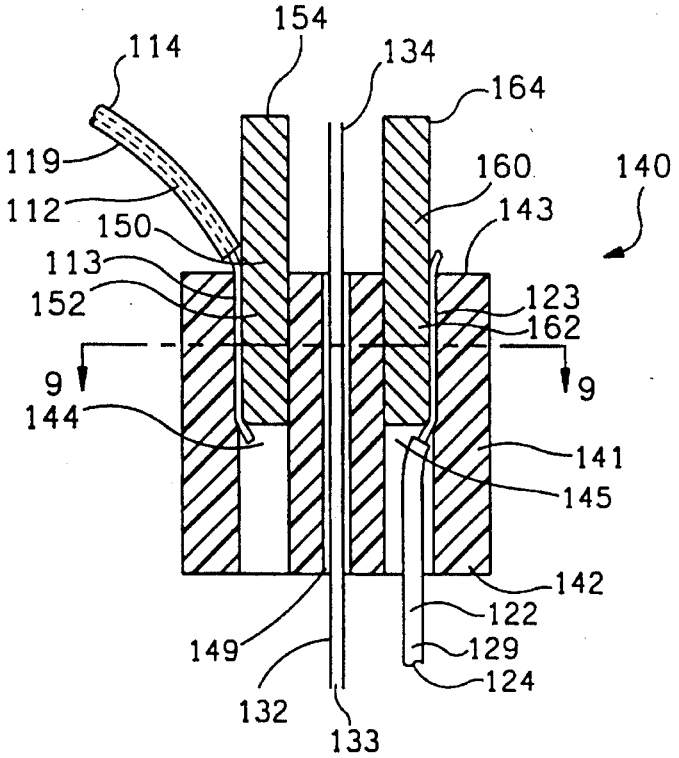
FIG. 8 is a vertical cross-sectional view of a series male plug.
Figure 9:
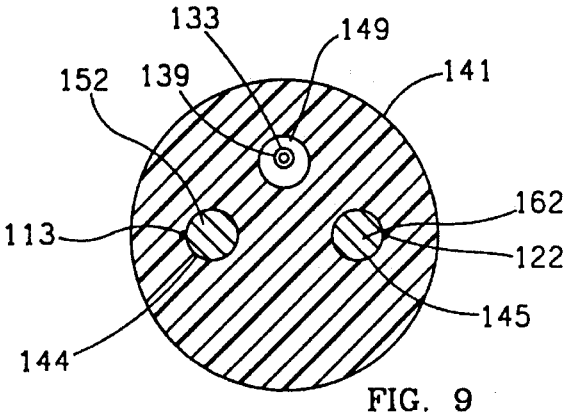
FIG. 9 is a horizontal cross-section of the series plug of FIG. 8 taken on line 9—9.
Figure 10:
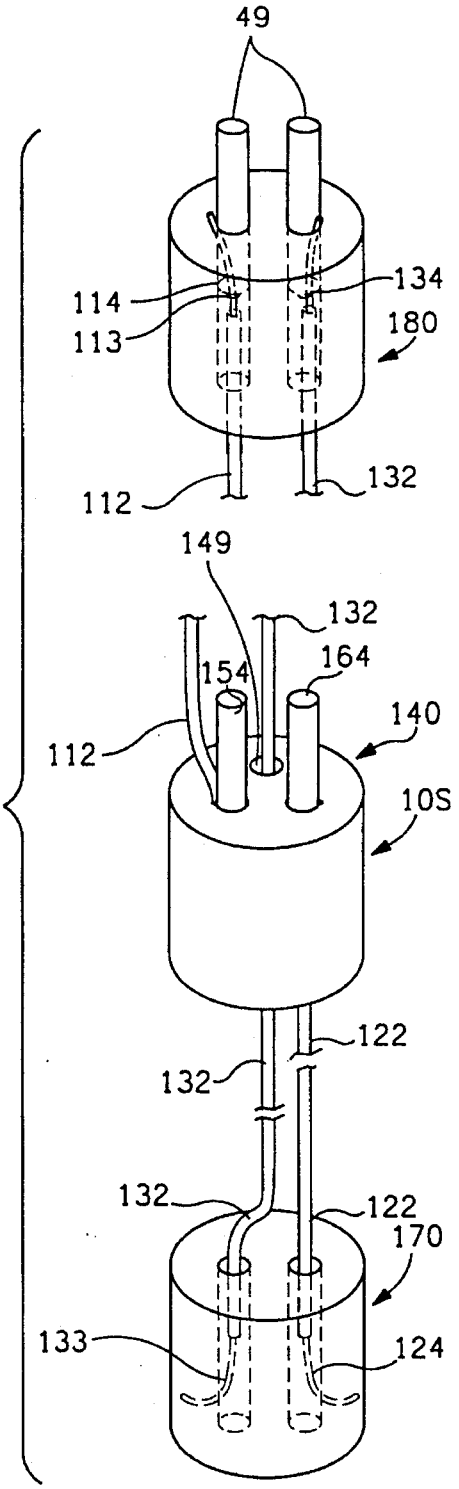
FIG. 10 is an enlarged plan view, partially cut away, of an alternate embodiment of a series wiring segment of FIG. 1 using the series male plug of FIG. 8.

Turning now to FIGS. 8–10, FIG. 8 is a vertical cross-sectional view of a series male plug connector, denoted generally as 140 and FIG. 9 is a horizontal cross-section of the series plug 140 taken on line 9—9 of FIG. 8. Series connector 140 general comprises an electrically insulative and resilient plug body 141, having a first end 142 and a plug end 143 and having first and second bores 144, 145 in plug end 143. Preferably body 141 is cylindrical and constructed similarly to body 41 of connector 40. A first electrically conductive wire 112 has a first end 113 disposed in first bore 144 and a second end 114. A first electrically conductive pin 150 has a first end 152 frictionally fitted in first bore 144 so as to retain first end 113 of first wire 112 in first bore 144 and so as to be in electrical contact with first end 113 first wire 112 and has a second end 154 protruding out from the plug end 143 and forming a first tine of series male connector 140.

A second electrically conductive wire 122 has a first end 123 disposed in second bore 145 and a second end 124. A second electrically conductive pin 160 has a first end 162 frictionally fitted in the second bore 145 so as to retain first end 123 of second wire 122 in second bore 145 and so as to be in electrical contact with first end 123 of second wire 122 and has a second end 164 protruding out from plug end 143 and forming a second tine of male connector 140. The second ends 114, 124 of first and second wires 112,122 are for connection to a voltage source such that an electrical potential exists between plug pins or tines 150, 160. Although the bores 144, 145, shown, pass completely through body 141; in plug 140's simplest sense, bores 144, 145 may be blind bores in the plug end 143 and the first ends 113,123 of both wires can be inserted into bores 144, 145 from the plug end 143. Also, if the wires 112, 122 have insulation 119, 129 as shown, the insulation 119, 129 has to be removed from first ends 113, 123 to make contact with pins 150, 160.

The series male connector 140 may include a third bore 149 passing through plug body 141 between first end 142 and plug end 143 and a third electrically conductive wire 132 having a first end 133 and a second end 134 and disposed through third bore 149 such that first end 133 of third wire 132 protrudes from first end 142 of plug body 141 and such that second end 134 of third wire 132 protrudes from plug end 143 of plug body 141. Third wire 132 may be insulated with insulation 139.

FIG. 10 is an enlarged plan view, partially cut away, of an alternate embodiment 10S of a wiring segment 10 of FIG. 1 using the series male plug 140 of FIG. 8 instead of the parallel male plug 40 of FIGS. 2 and 3.

Series wiring segment 10S generally comprises the series male plug connector 140 of FIG. 8, a first electrical connector 170 and a second electrical connector 180. Serial plug 140 may be attached to an electrical devise, such as lamp assembly 50, to complete the electrical connection between first and second wires 112, 122.

First electrical connector 170, shown, is a female connector constructed as shown in FIG. 6 but may be a male connector similar to 180. Second end 124 of second wire 122 is attached to first connector 170 to form a first terminal of second connector 180.

Second connector 180, shown, is a male connector similar to connector 40 of FIG. 3 except with the first ends 12S, 16S of wires 12, 16 removed at the plug end. Second end 114 of first wire 112 is attached to second connector 180 to form a first terminal of second connector 180. Second connector 180 may be a female connector as shown in FIG. 6.

Third wire 132 disposed through third bore 149 has a first end 133 connected to first electrical connector 170 to form a second terminal of first connector 170 and a second end 134 connected to second electrical connector 180 to form a second terminal of second connector 180. With two of the connectors connected to electrical devices and the third connected to a voltage source, third wire 132 completes the circuit. Similar to FIG. 2, a sleeve 69 may encompass connector 140 and lamp assembly 50 such that all of the wires pass through contained in the sleeve 69.

It can be seen that a number of serial wiring segment 10S can be used to make a balloon display as seen in FIG. 1 such that a lamp can easily be replaced and such that the display can be easily changed to form other letters or designs.

Having described the invention, it can be seen that it provides a very small, easily-constructed and light-weight parallel male plug device and a convenient wiring device for replacement of any balloon or bulb in a balloon display. Additionally, the devices require no soldering and no application of additional insulation.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention. In the following claims, the term translucent includes the more restrictive term of transparent.

I claim:

1. A series male connector comprising:

an electrically insulative and resilient plug body having a first end and a plug end and having:

a first bore in said plug end;

a second bore disposed through said plug body between said first end of said plug body and said plug end; and a third bore disposed through said plug body between said first end of said plug body and said plug end;

a first electrically conductive wire having:

a first end disposed in said first bore; and a second end protruding out of said plug end of said first bore;

a first electrically conductive pin having:

a first end frictionally fitted in said first bore so as to retain said first end of said first wire in said first bore and so as to be in electrical contact with said first end of said first wire; and a second end protruding out from said plug end and forming a first tine of said male connector;

a second electrically conductive wire having:

a first end disposed in said second bore; and a second end protruding out of said first end of said plug body;

a second electrically conductive pin having:

a first end frictionally fitted in said second bore so as to retain said first end of said second wire in said second bore and so as to be in electrical contact with said first end of said second wire; and a second end protruding out from said plug end and forming a second tine of said male connector; and a third electrically conductive wire having a first end and a second end; said third wire disposed through said third bore such that said first end of said third wire protrudes from said first end of said plug body and forms a wire pair with said second end of said second wire and such that said second end of said third wire protrudes from said plug end of said plug body and forms a wire pair with said second end of said first wire.

2. A wiring segment comprising:

a series male connector comprising:

an electrically insulative and resilient plug body having a first end and a plug end and having:

a first bore in said plug end:

a second bore disposed through said plug body between said first end of said plug body and said plug end; and a third bore disposed through said plug body between said first end of said plug body and said plug end;

a first electrically conductive wire having:

a first end disposed in said first bore; and a second end protruding out of said plug end of said first bore;

a first electrically conductive pin having:

a first end frictionally fitted in said first bore so as to retain said first end of said first wire in said first bore and so as to be in electrical contact with said first end of said first wire; and a second end protruding out from said plug end and forming a first tine of said male connector;

a second electrically conductive wire having:

a first end disposed in said second bore; and a second end protruding out of said first end of said plug body; and a second electrically conductive pin having:

a first end frictionally fitted in said second bore so as to retain said first end of said second wire in said second bore and so as to be in electrical contact with said first end of said second wire; and a second end protruding out from said plug end and forming a second tine of said male connector;

a first electrical connector; said second end of said second wire attached to said first connector to form a first terminal of said first connector;

a second electrical connector; said second end of said first wire attached to said second connector to form a first terminal of said second connector; and a third electrically conductive wire having a first end and a second end; said third wire disposed through said third bore such that said first end of said third wire protrudes from said first end of said plug body and is attached to said first connector to form a second terminal of said first connector and such that said second end of said third wire protrudes from said plug end of said plug body and is attached to said second connector to form a second terminal of said second connector.

3. The wiring segment of claim 2 further including:

a lamp assembly connected to said tines of said male plug.

4. The wiring segment of claim 3 wherein:

said lamp assembly includes:

a lamp having bare a pair of bare leads; and a female connector body including:

a receptacle end;

a lamp end; and a pair of through bores therebetween, each containing a said lamp bare lead and frictional mated to said tines of said male connector such that each said tine makes electrical contact with a said lamp lead.

5. The wiring segment of claim 4 further including:

a translucent sleeve surrounding said male connector and said lamp assembly.

6. A balloon display comprising:

a first inflated balloon having a tube therethrough;

a second inflated balloon including an internal lamp; and a wiring segment comprising:

a series male connector comprising:

an electrically insulative and resilient plug body having a first end and a plug end and having a first bore in said plug end and a second bore between said first end of said plug body and said plug end;

a first electrically conductive wire having:

a first end disposed in said first bore; and a second end protruding out of said plug end of said first bore;

a first electrically conductive pin having:

a first end frictionally fitted in said first bore so as to retain said first end of said first wire in said first bore and so as to be in electrical contact with said first end of said first wire; and a second end protruding out from said plug end and forming a first tine of said male connector;

a second electrically conductive wire having:

a first end disposed in said second bore; and a second end protruding out of said first end of said plug body; and a second electrically conductive pin having:

a first end frictionally fitted in said second bore so as to retain said first end of said second wire in said second bore and so as to be in electrical contact with said first end of said second wire; and a second end protruding out from said plug end and forming a second tine of said male connector;

a third electrically conductive wire having a first end and a second end;

a first electrical connector; said second end of said second wire attached to said first connector to form a first terminal of said first connector and said first end of said third wire attached to said first connector to form a second terminal of said second connector; and a second electrical connector; said second end of said first wire attached to said second connector to form a first terminal of said second connector and said second end of said third wire attached to said second connector to form a second terminal of said second connector; said second connector electrically connected to said second inflated balloon internal light; and a lamp assembly electrically connected to said tines of said male connector;

said wiring segment disposed through said tube of said first balloon such that said male connector and said lamp assembly are within said tube within said first balloon.

7. A parallel male connector comprising:

an electrically insulative and resilient body having a first end and a plug end and first and second bores therebetween;

a first electrically conductive wire; said first wire being insulated and having a mid-section; said mid-section having a non-insulative portion; said first wire disposed through said first bore such that said non-insulative portion is within said first bore near said plug end;

a first electrically conductive pin having a first end frictionally fitted in said plug end of said first bore so as to be in electrical contact with said first wire non-insulative portion and a second end protruding out from said plug end and forming a first tine of the male connector;

a second electrically conductive wire; said second wire being insulated and having a mid-section; said mid-section having a non-insulative portion; said second wire disposed through said second bore such that said non-insulative portion is within said second bore near said plug end; and a second electrically conductive pin having a first end frictionally fitted in said plug end of said second bore so as to be in electrical contact with said second wire non-insulative portion and a second end protruding out from said plug end and forming a second tine of the male connector.

8. A method of attaching a parallel male connector to the middle of a pair of insulated wires comprises the steps of:

obtaining a pair of insulated electrically conductive wires;

obtaining an electrically insulative and resilient body having a first end and a plug end and first and second bores therebetween;

obtaining a first electrically conductive pin having a first end dimensioned to frictionally fit in the plug end of the first bore and a second end;

obtaining a second electrically conductive pin having a first end dimensioned to frictionally fit in the plug end of the second bore and a second end;

removing the insulation from the mid-section of the first wire of the pair;

removing the insulation from the mid-section of the second wire of the pair;

passing the first wire through the first bore of the body such that the non-insulative portion is within the first bore near the plug end;

inserting the first end of the first pin in the plug end of the first bore so as to be in electrical contact with the first wire non-insulative portion and such that the first pin second end protrudes out from the plug end and forms the first tine of the male connector;

passing the second wire through the second bore of the body such that the non-insulative portion is within the second bore near the plug end;

inserting the first end of the second pin in the plug end of the second bore so as to be in electrical contact with the second wire non-insulative portion and such that the second pin second end protrudes out from the plug end and forms the second tine of the male connector;

removing the insulation from the mid-section of the first wire of the pair;

removing the insulation from the mid-section of the second wire of the pair;

passing the first wire through the first bore of the body such that the non-insulative portion is within the first bore near the plug end; and inserting the first end of the first pin in the plug end of the first bore so as to be in electrical contact with the first wire non-insulative portion and such that the second end protrudes out from the plug end and forms the first tine of the male connector.

9. A wiring segment comprising:

a pair of insulated electrically conductive wires comprising:

a first wire having a first end, a second end and a midsection; said first wire mid-section having a non-insulative portion;

a second wire having a first end, a second end and a midsection; said first wire mid-section having a non-insulative portion;

a first electrical connector attached to said wires first ends;

a second electrical connector attached to said wires second ends;

a parallel male connector attached to said wires between said ends comprising:

an electrically insulative and resilient body having a first end and a plug end and first and second bores therebetween; disposed through said first bore such that said non-insulative portion is within said first bore near said plug end;

a first electrically conductive pin having a first end frictionally fitted in said plug end of said first bore so as to be in electrical contact with said first wire non-insulative portion and a second end protruding out from said plug end and forming a first tine of the male connector;

a second electrically conductive wire; said second wire being insulated and having a mid-section; said mid-section having a non-insulative portion; said second wire disposed through said second bore such that said non-insulative portion is within said second bore near said plug end; and a second electrically conductive pin having a first end frictionally fitted in said plug end of said second bore so as to be in electrical contact with said second wire non-insulative portion and a second end protruding out from said plug end and forming a second tine of the male connector.

10. The wiring segment of claim 9 further including:

a lamp assembly connected to said tines of said parallel male connector.

11. The wiring segment of claim 10 wherein:

said lamp assembly includes:

a lamp having bare a pair of bare leads; and a female connector body including:

a receptacle end;

a lamp end; and a pair of through bores therebetween, each containing a said lamp bare lead and frictional mated to said tines of said parallel male connector such that each said tine makes electrical contact with a said lamp lead.

12. The wiring segment of claim 11 further including:

a translucent sleeve surrounding said parallel male connector and said lamp assembly.

13. A balloon display comprising:

a first inflated balloon having a tube therethrough;

a second inflated balloon including an internal lamp;

a wiring segment comprising:

a pair of insulated electrically conductive wires comprising:

a first wire having a first end, a second end and a midsection; said first wire mid-section having a non-insulative portion;

a second wire having a first end, a second end and a midsection; said first wire mid-section having a non-insulative portion;

a first electrical connector attached to said wires first ends;

a second electrical connector attached to said wires second ends and electrically connected to said second inflated balloon internal light;

a parallel male connector attached to said wires between said ends comprising:

an electrically insulative and resilient body having a first end and a plug end and first and second bores therebetween; disposed through said first bore such that said non-insulative portion is within said first bore near said plug end;

a first electrically conductive pin having a first end frictionally fitted in said plug end of said first bore so as to be in electrical contact with said first wire non-insulative portion and a second end protruding out from said plug end and forming a first tine of the male connector;

a second electrically conductive wire; said second wire being insulated and having a mid-section; said mid-section having a non-insulative portion; said second wire disposed through said second bore such that said non-insulative portion is within said second bore near said plug end; and a second electrically conductive pin having a first end frictionally fitted in said plug end of said second bore so as to be in electrical contact with said second wire non-insulative portion and a second end protruding out from said plug end and forming a second tine of the male connector; and a lamp assembly electrically connected to said tines of said parallel male connector;

said wiring segment disposed through said tube of said first balloon such that said parallel male connector and said lamp assembly are within said balloon within said tube.

14. The balloon display of claim 13 wherein:

said lamp assembly includes:

a lamp having bare a pair of bare leads; and a female connector body including:

a receptacle end;

a lamp end; and a pair of through bores therebetween, each containing a said lamp bare lead and frictional mated to said tines of said male parallel connector such that each said tine makes electrical contact with a said lamp lead.

15. The balloon display of claim 14 wherein: said wiring segment further includes:

a translucent sleeve surrounding said parallel male connector and said lamp assembly within said tube.

* * * * *